United States Patent [19]

Kuck

[11] Patent Number: 4,522,537

[45] Date of Patent: Jun. 11, 1985

[54] ICE CRIB

[75] Inventor: David L. Kuck, Oracle, Ariz.

[73] Assignee: Iceberg Cribs, Inc., Oracle, Ariz.

[21] Appl. No.: 376,254

[22] Filed: May 7, 1982

[51] Int. Cl.[3] ..... E21D 15/00

[52] U.S. Cl. ..... 405/288; 299/11

[58] Field of Search ..... 405/130, 132, 288, 289; 299/11

[56] References Cited

U.S. PATENT DOCUMENTS

| | | | |
|---|---|---|---|
| 4,072,015 | 2/1978 | Morrell et al. | 405/289 |
| 4,102,138 | 7/1978 | Dreker | 405/289 X |
| 4,377,353 | 3/1983 | Hoberstorfer et al. | 405/130 |

FOREIGN PATENT DOCUMENTS

| | | | |
|---|---|---|---|
| 1069549 | 11/1959 | Fed. Rep. of Germany | 299/11 |
| 2621680 | 11/1977 | Fed. Rep. of Germany | 299/11 |
| 617600 | 7/1978 | U.S.S.R. | 299/11 |
| 756042 | 8/1980 | U.S.S.R. | 299/11 |

*Primary Examiner*—David H. Corbin

*Attorney, Agent, or Firm*—Cahill, Sutton & Thomas

[57] ABSTRACT

An ice crib for use in retreat mining to support the overburden is formed of fresh water ice, the freezing and melting of which is controlled in situ by flow therethrough of temperature regulated brine.

25 Claims, 10 Drawing Figures

ICE CRIB

The present invention relates to mining equipment and, more particularly, to ground support equipment for use in underground openings.

In underground mining, pillars are left within any mined cavity or room in order to provide support for the overburden. Usually, attempts are made at recovering the material of value represented by the pillars before abandonment of the mined area or termination of the mining operation. Particularly, in coal and other mining operations, mechanical means are usually employed to serve the function of pillars.

During recovery of the pillars or mechanical substitutes therefor, a continuing danger of injury, loss of life, damage or burial of equipment continually exists.

In U.S. Pat. No. 1,207,569 there is described a method for supporting the roof of mine tunnels or other underground cavities during second mining operations and to provide a substitute for the pillars to be mined, props, cogs or pillars that have become weakened. It is suggested that the mine cavities be filled with blocks of ice, which ice is caused to flow to fill all of the cavities by placing the ice under very substantial pressure. A similar system of employing ice flow is described in U.S. Pat. No. 3,790,215. Herein, the mine is filled with ice which ice progressively and continuously flows during the primary mining operation to provide requisite support for lateral and hanging rock walls. Necessarily, a very substantial pressure equivalent to a vertical height of twenty-two or more meters of ice is necessary.

Roof supports in the configuration of air inflatable tires are described in U.S. Pat. No. 2,861,429. Structure is also described therein for accommodating transport of such supports from one location to another within the mine. U.S. Pat. No. 2,990,166 is directed to air inflatable cushions cylindrical in configuration. U.S. Pat. No. 3,508,408 is directed to a pneumatic cushion particularly adapted for coal mines and having particularly oriented multiple plies of textile cords extending helically thereabout. U.S. Pat. No. 4,072,015 is directed to air inflatable bladders for plugging bore holes to permit injection and containment of a fluid within the bore hole to provide ground support for the bore hole.

The present invention is directed to a crib formed of ice to serve as a pillar for support of the overburden. The apparatus employed includes a length of two concentric tubings rolled or folded upon itself to provide a cross-section, when inflated, equivalent to that of the space to be occupied. Fresh water is injected into the outer tubing and brine, chilled to a temperature below zero degrees centigrade, flows continuously through the inner tubing. The brine will draw off heat from the surrounding fresh water and in due course the fresh water will freeze. The resulting block of ice will provide structural support in the manner of a pillar or other support whether a jack, a concrete column or a timber crib. On completion of the mining operation and to bring about cave-in, the flow of chilled brine may be stopped to permit gradual melting of the ice; alternatively, non-chilled brine may be passed through the block of ice to draw off heat, promote more rapid melting and partially chill the outflowing brine for use in constructing other ice cribs. The melting of the crib is relatively slow which provides adequate time for evacuation of all equipment and personnel prior to cave-in. It may also be noted that water expands when it freezes, which expansion serves in the manner of providing a pre-stressed pillar for the roof, drive or drift within which the ice crib is to be formed. This capability exists only with very expensive mechanical jacks.

It is therefore a primary object of the present invention to provide an inexpensive readily erectable ice crib.

Another object of the present invention is to provide a pre-stressed ice crib.

Yet another object of the present invention is to provide an expendable ice crib.

Still another object of the present invention is to provide structure for forming an ice crib of unlimited size and configuration.

A further object of the present invention is to provide an ice crib automatically conformable to the space within which it is to be used.

A yet further object of the present invention is to provide an ice crib for underground openings which will permit on command the ground to subside and close the underground openings.

A still further object of the present invention is to provide an ice crib compactible for storage and transportation.

These and other objects of the present invention will become apparent to those skilled in the art as the description thereof proceeds.

The present invention may be described with greater specificity and clarity with reference to the following drawings, in which.

Figure 1:
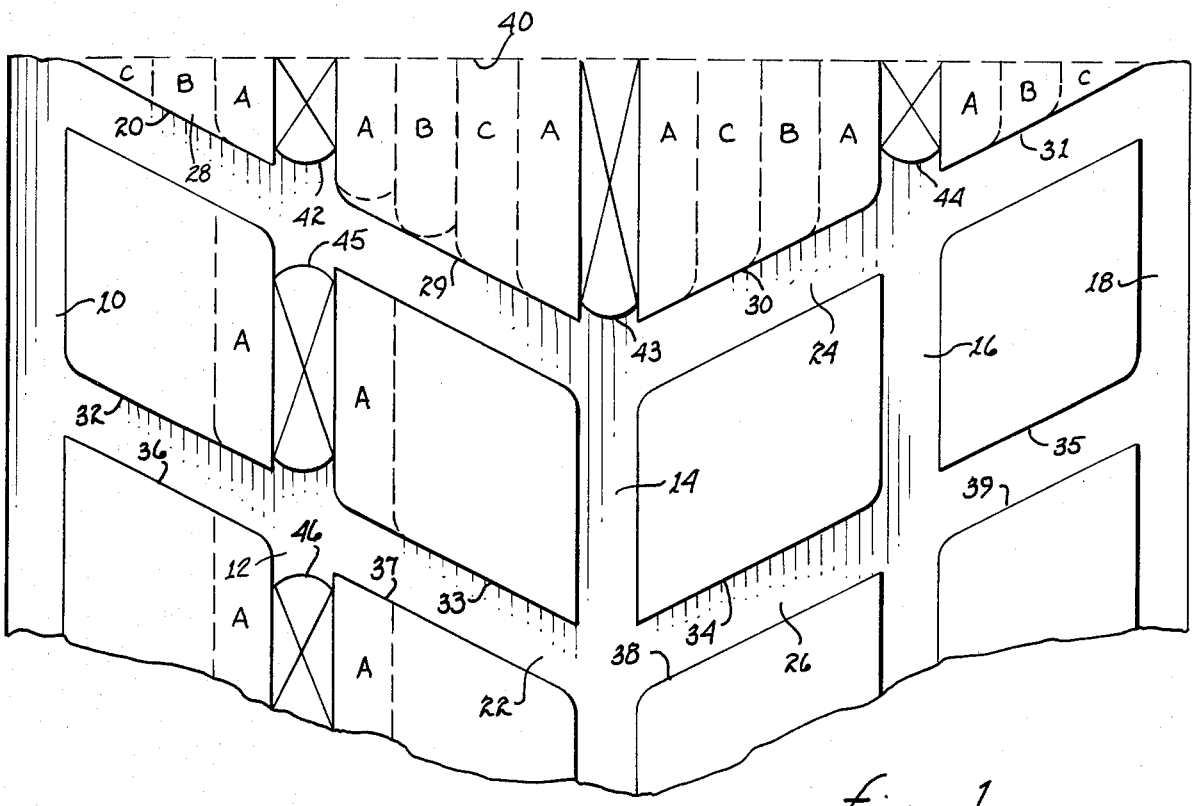
FIG. 1 is a plan view of an underground mine having ice cribs for support of the overburden.

Referring to FIG. 1, there is shown a mine having an underground room in which retreat mining is in progress and prior to robbing the pillars. A plurality of drives (drifts) 10, 12, 14, 16 and 18 intersect one or more of panels (cross cuts) 20, 22, 24 and 26. A plurality of pillars are defined by the respective circumscribing drives and drifts, which pillars provide support for the overlying ground or overburden.

The pillars represent material of value to be mined but mining of the pillars by retreat mining would cause subsidence and cave in of the overburden unless support therefor were maintained. These pillars are identified by reference numerals 28 through 39. The mining limit of the mine is identified by reference numeral 40, which limit represents the extent to which mining may be conducted as a result of limitations in the lease or ownership of the ground. Similarly, drives 10 and 18 represent the lateral extent to which the mine may be mined.

Prior to mining of any of the pillars, the present invention is employed to develop a block of ice located within one or more of the drives and drifts to provide support for the overburden during mining of the pillars. These blocks of ice produced by the present invention and referred to as ice cribs are identified by numerals 42 to 46. It may be noted that the ice cribs formed vary in length to meet the requirements of each particular location and which variability is a feature of the present invention. Moreover, ice cribs 42, 43 and 44 provide vertical support for the overburden and extend between the left and right sides of the respective drives and panels and to mining limit 40. Ice cribs 45 and 46 provide support for the overburden and extend between the left and right ribs within drive 12.

After erection of ice cribs 42 to 46, the first cut made in each pillar is adjacent the respective ice crib and identified by the letter A. On completion of each cut A, an ice crib is formed in the space vacated to provide a temporary substitute support for the overburden. Further cuts B and C are made successively in each pillar. After each such further cut, if needed, a further ice crib is substituted in place of the cut to provide support for the overburden when required and dependent upon the structure and composition of the overburden. After each pillar has been removed, the support previously provided thereby is now obtained from the respective ice crib(s). Such support will continue until the ice crib(s) melts.

By controlling the rate of ice melt of each ice crib, the rapidity of subsidence of the overburden can be controlled. Such control affords total and complete removal of all mining equipment, materials and personnel from each given area to eliminate injury or loss due to rock burst or subsidence. It may also be pointed out that as no timber cribs, metal jacks, chocks or other equipment need be recovered by personnel, the safety hazards attendant such recovery are totally eliminated.

Because of the relatively low cost of the structure of which each ice crib is formed, nonrecovery thereof is generally affordable; the loss of the ice crib structure may be somewhat ameliorated by using the melting ice crib as a heat sink to chill the fluid to be used in forming other ice cribs. An ice crib used as a heat sink will acquire heat more rapidly than otherwise. The heat acquisition can be regulated to some extent and thereby be used to melt the ice crib at a relatively controllable rate.

Figure 2:
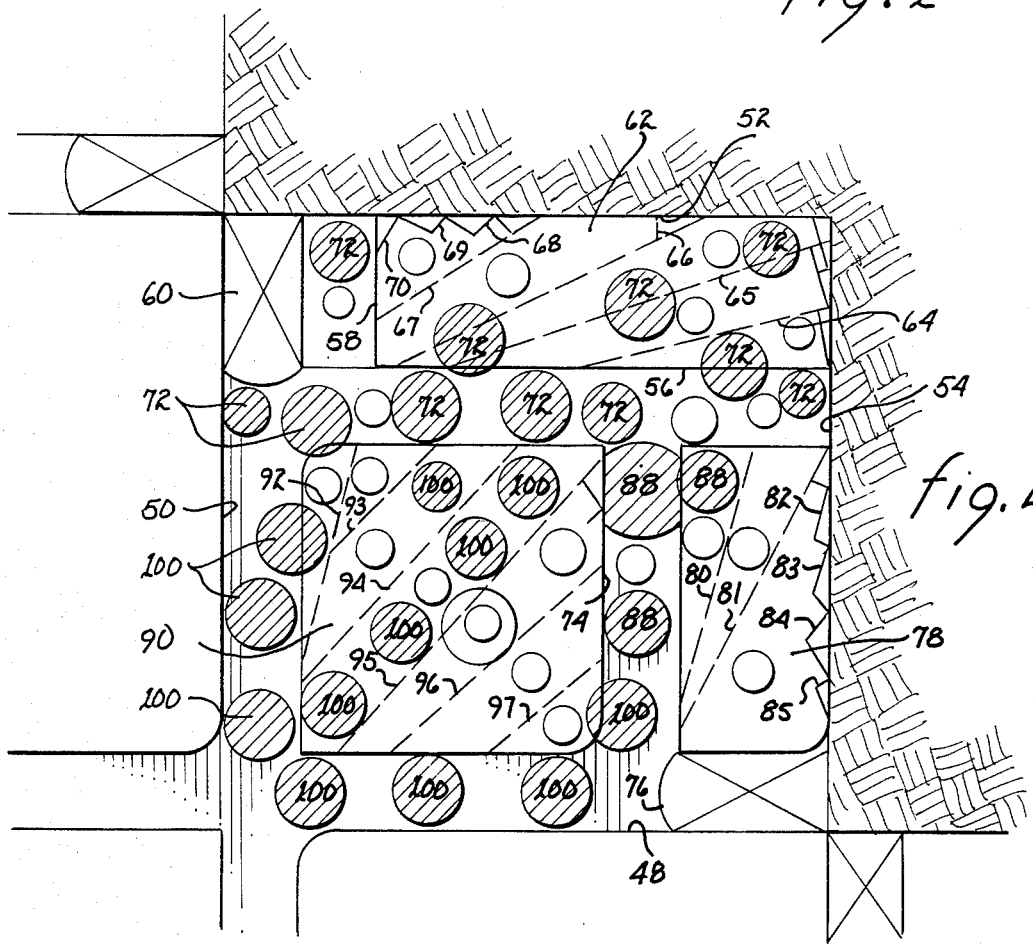
FIG. 2 is a plan view of a retreat mining operation having ice cribs to support the overburden.

Referring to FIG. 2, there is shown a room containing material of value to be mined by the pocket and wing method. The room is bounded by drive 48, drift 50, limit 52 defining an edge of gob and limit 54 defining a further edge of the gob. First, a pocket 56 is mined from drift 50 to limit 54. Secondly, a further pocket 58 is mined from pocket 56 to limit 52. Prior to the mining of these pockets and to provide support for the overburden which may be needed as a result of the unsupported area defined at or about the intersection of pockets 56, 58 and drift 50, ice crib 60 is developed at the end of drift 56 adjacent limit 52.

The mining of pillar 62 of material of value bounded by pockets 56, 58 and limits 52, 54 is made by taking successively a plurality of angled cuts 64, 65, 66, 67, 68, 69 and 70. On completion of one or more of the cuts, ice cribs 72, circular in plan form as illustrated, may be erected within the areas defined in FIG. 2 as pockets, 56, 58 and cuts 64 through 70. Ice cribs 72 may be of different size (diameter), depending upon the composition of the overburden and the resultant loads to be supported. The placement of ice cribs 72 is similarly to be determined by the structural integrity of the overburden and will vary from location to location. Accordingly, the placement thereof depicted in FIG. 2 is to be construed only as representative of the ice crib size and location of placement.

The material of value to be mined between pocket 56 and drive 48 is divided into two areas by mining a further pocket 74 extending from drive 48 to pocket 56. Prior or subsequent thereto, ice crib 76 may be erected within drive 48 adjacent limit 54 as a substitute for the support withdrawn by mining of the material of value.

Pillar 78 is mined by a series of angled cuts 80, 81, 82, 83 and 85. Subsequent to one or more of these cuts, further ice cribs 88 may be located within pocket 74 and in the areas represented by one or more of the cuts made into pillar 78. Again, the number and size of ice cribs 88 is primarily dependent upon the composition and structural integrity of the overburden.

Pillar 90 is mined by taking a plurality of cuts 92, 93, 94, 95, 96 and 97. Subsequent to taking one or more of these cuts in pillar 90, further ice cribs 100 may be located within drive 48, drift 50 and one or more of the areas represented by cuts 92 to 97. Again, the selection of size and number of such ice cribs is dependent upon the composition and structural integrity of the overburden.

After all of the material of value has been removed from the room bounded by drive 48, drift 50 and limits 52, 54, subsidence or cavein of the overburden may be undertaken. By selective melting of ice cribs 60, 72, 76, 88 and 100, controlled and regulated subsidence may be accomplished. Preferably, the melting of the ice cribs is regulated to extend uniformly from limits 52, 54 to drive 48 and drift 50.

It may be appreciated that all mining equipment and materials to be removed from the room can be so removed substantially in advance of any subsidence. Furthermore, all personnel can and will be evacuated long before any subsidence occurs. Therefore, loss of equipment and material is avoided and hazards to personnel as a result of the subsidence are totally eliminated.

Figure 3:
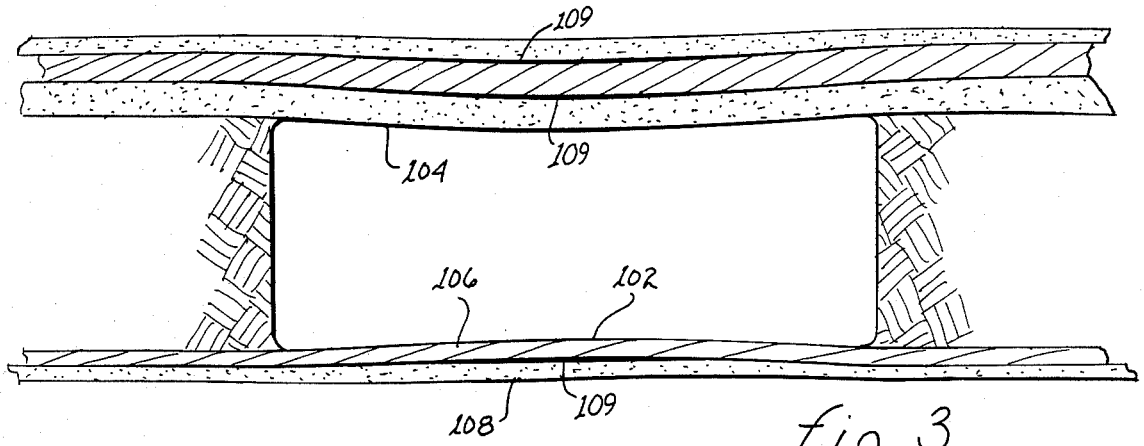
FIG. 3 illustrates bed separation.

Referring to FIG. 3, there is illustrated an elevational view of a conventional drive or drift, such as illustrated in plan view in FIGS. 1 and 2. As soon as the material of value has been removed to form the drive or drift, floor 102 begins to heave and roof 104 begins to sag. This usually results in separation 109 between beds 106, 108 and beds 110, 112 and 114. The separation further weakens the structural integrity of the roof and at some point failure will occur resulting in partial or complete closure of the drive or drift.

Figure 4:
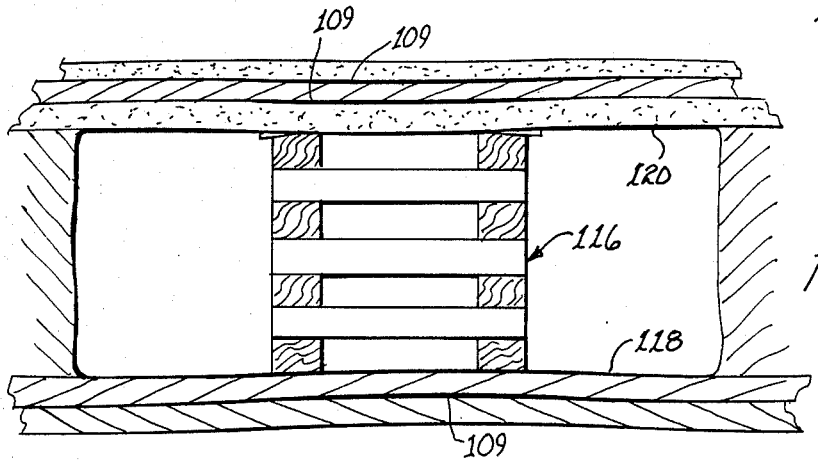
FIG. 4 illustrates non-closure of bed separation with a prior art timber crib.

A conventional timber crib 116 is illustrated in FIG. 4. Such a timber crib is placed within an opening or drive or drift to provide physical support between floor 118 and roof 120. The timber crib will generally halt further bed separation for a period of time. However, the continuing pressure placed upon the timber crib coupled with the fact that a timber crib is compressible will still result in continuing but decelerated sag of roof 120. At some point in time, and it is only a matter of time, subsidence or cavein will occur. It may also be noted that the timber crib is generally not recoverable without substantial hazard to both equipment and personnel. Alternatives to the traditional timber crib are hydraulic jacks which can be expanded in a manner a wooden crib cannot be and any separation between the layers in a roof or floor can be closed; but, such hydraulic jacks are too expensive to be used as disposable items. On removal thereof, hazards to both equipment and personnel will and do exist. Other means such as chocks of various types have been used but the underlying problems continue to remain with a change being only one degree of severity.

Figure 5:
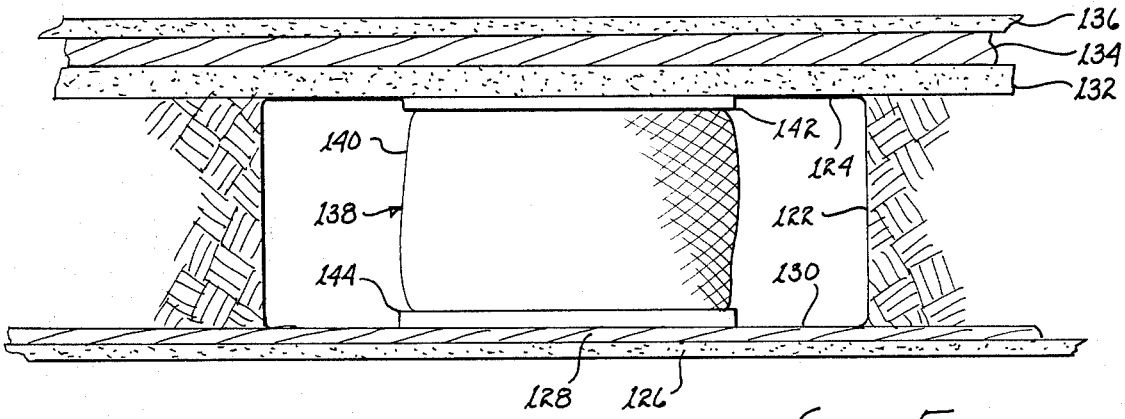
FIG. 5 illustrates closure of bed separation within an ice crib.

Referring to FIG. 5, there is shown an opening 122 of a drive or drift, of the type shown in FIG. 3. To support roof 124 and prevent separation of beds 126, 128 in floor 130 and between beds 132, 134 and 136 in the roof, an ice crib 138 is placed therein. The ice crib includes an envelope 140 generally defining the height, width and length of the ice crib and which envelope is generally commensurate with the cross-section of opening 122 and the length along which the ice crib is to provide support. On freezing of the water to form the ice crib volumetric expansion occurs. Such expansion results in preloading or prestressing the beds of floor 130 and roof 124 to preclude any separation from beginning, or, if it has begun, to close any separation between the beds in the floor and/or the roof. Thus, the benefits of a hydraulic jack are achieved by the ice crib and yet the expenses attendant a hydraulic jack, both in terms of capital costs, maintenance and labor are obviated.

To reduce the rate of heat flow to ice crib 138 from floor 130 or roof 124, pads of insulation 142, 144 may be employed. Such pads of insulation also have a secondary benefit in that uneveness of both the floor and the roof are somewhat accommodated by penetration into the pads and thereby reduce the degree and extent of any stress concentrations that would otherwise be produced in envelope 140 of the ice crib.

Figure 6:
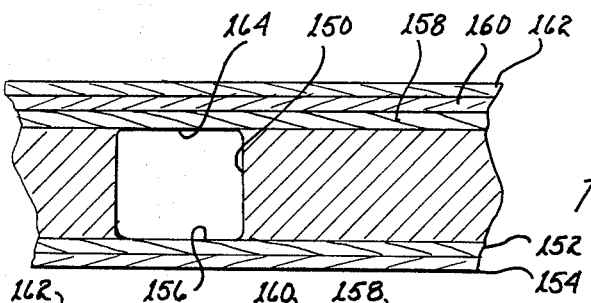
FIGS. 6, 7 and 8 illustrate, serially, use of an ice crib in a punch mine operation.
Figure 7:
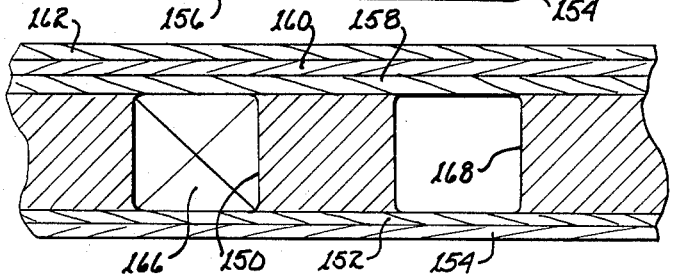

Referring jointly to FIGS. 5, 6 and 7, there is shown a method for punch mining and with which method the ice cribs are particularly useful. The process of punch mining is generally employed where the structural integrity of the layers in the overburden is low or otherwise requires closely spaced pillars or supports to prevent subsidence or rock burst. As will be described hereinafter, no pillars of material of value need be left in the punch mine process to be described and illustrated in FIGS. 6, 7 and 8. An initial punch mine opening 150 is shown in FIG. 6. This usually results in some separation between beds 152, 154 in floor 156 and between beds 158, 160 and 162 in roof 164.

Figure 8:
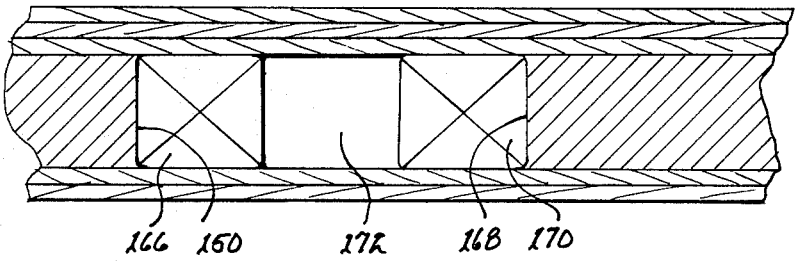

On placement of an ice crib 166 within opening 150, as shown in FIG. 7, the separation between beds 152 and 154 and beds 158, 160 and 162 are closed or at least further separation is precluded because of the pressure and support provided by the mass of ice crib 166. Thereafter or commensurate with mining of opening 150, a second opening 168 can be mined. The separation in the beds of the floor and roof attendant opening 160, as described with respect to FIG. 6, will again exist. Such separation and the resulting voids can be closed by erecting in the opening a further ice crib 170 as shown in FIG. 8.

Pillar 172 of material of value intermediate ice cribs 166 and 170 may now be mined as the floor and roof adjacent thereto have been stabilized by these ice cribs. After an opening 174 is formed, further separation of the attendant floor and roof may occur. Such separation, assuming that subsidence of the overburden is not yet desired, can be halted or corrected by erecting a further ice crib within opening 174. After all material of value has been removed by mining a plurality of openings in the same or similar manner described above, subsidence of the overburden may be achieved in regulated and controlled manner by selective melting of the various ice cribs. The requirements attendant present mining techniques of having to leave pillars of material of value intermediate openings are obviated by the ice cribs. Again, it may be noted that all hazards and potential losses attendant equipment, materials and personnel as a result of the dangers attendant prior art planned subsidence or accidental subsidence have been obviated.

Figure 9:
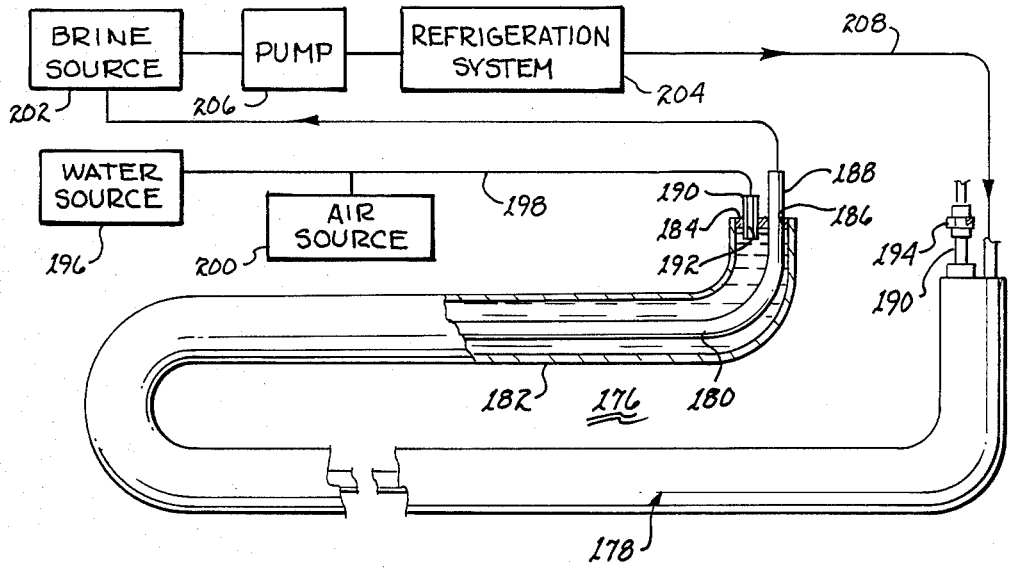
FIG. 9 illustrates the structure of the present invention.

Referring to FIG. 9, there is illustrated an apparatus 176 formed by a double walled tubing 178 having an inner tube 180 and an outer tube 182. Closure means, such as end cap 184 extends across the mouth at each end of outer tube 182. An aperture 186 is provided in the end cap to accommodate passage of inner tube 180 or an extension 188 thereof therethrough. A pipe 190 or like passageway extends through aperture 192 in the end cap. The pipe provides a means for fluid communication with the interior of outer tube 182; that is, the annular space between the inner and outer tube. One or both ends of pipe 190 may include a coupling 194 for interconnecting the pipe with another segment of double wall tubing 178 to provide fluid communication therebetween; alternatively, the coupling may be replaced by a plug or other closure means to prevent flow through pipe 190.

Outer tube 182 serves as an envelope for containing a first fluid, such as fresh water, which is to be frozen to form the ice crib. Inner tube 180 serves as a conveying means for conveying a second fluid chilled below the temperature of the first fluid to draw heat from the first fluid and reduce its temperature.

Still referring to FIG. 9, a support system for operating the double wall tubing to convert it to an ice crib will be described. A water source 196 is interconnected with pipe 190 through conduit 198 to provide a flow of water into outer tube 182. An air source 200 may be selectively connectible to conduit 198 to provide an initial inflation of the outer tube to position the double wall tubing within the space the ice crib is to be formed. Closure means 194 may include means for expelling the air initially injected within outer tube 182 upon inflow of water from water source 196. After outer tube 182 has been filled with water, a cooling medium, such as brine, is pumped by pump 206 from a brine source 202 through a refrigeration system 204 to chill the brine to a temperature below the freezing temperature of the first fluid, or fresh water, through conduit 208. The out flow of brine through extension 188 is conveyed through conduit 210 back to the brine source.

As alluded to above, during deliberate melting of any ice crib, inner tube 180 thereof may be connected to the inner tube of another ice crib to be formed to precool or prechill the fresh water within the ice crib to be formed. This procedure serves two purposes. First, it can be used to accelerate melting of an existing ice crib; and, secondly, the resulting lowered temperature of the brine flowing into the ice crib to be formed will draw heat from the fresh water attendant the ice crib to be formed and thereby certain savings in refrigeration costs may be effected.

The apparatus illustrated in FIG. 9 from which an ice crib is to be formed, is, preferably, in the configuration of an elongated tube. Such a configuration permits folding or coiling of the tube to form almost any configuration necessary to fill the space within which an ice crib is to be formed.

Figure 10:
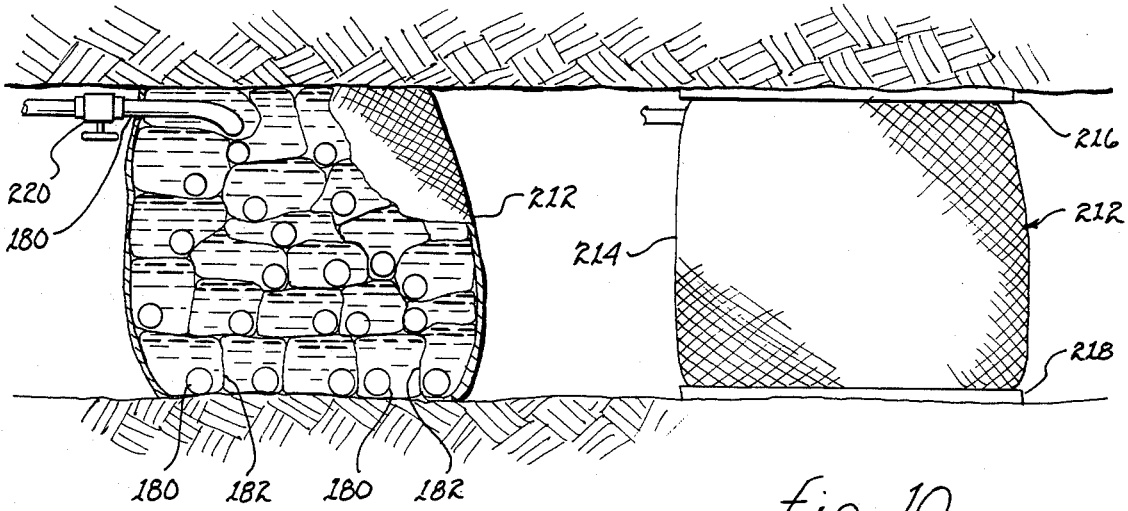
FIG. 10 illustrates a cross-sectional view of the present invention in operation.

Referring to FIG. 10, there is shown an ice crib 212 having an envelope 214 of a configuration commensurate with that of the ice crib to be formed. Within the envelope, the apparatus for containing and freezing the water is coiled, folded or otherwise positioned to occupy the requisite volume. It may be noted that a sheet of insulation 216 and 218 is located intermediate the overburden and the top of the envelope and the floor and bottom of the envelope, respectively. The use of such insulation serves two functions: First, it reduces heat transfer into the ice crib and thereby aids in prolonging melting of the ice crib; Secondly, it provides a means whereby the amount of pressure to be exerted by the ice crib upon freezing can be regulated through the known force necessary to partially or completely compress the sheets of insulation. As mentioned above, a third benefit available is that of shielding optional envelope 214 or the apparatus therein against puncture by pointed or sharp objects extending upwardly from the floor or depending from the overburden.

FIG. 10 also illustrates in partial cutaway view a cross-section of the apparatus shown in FIG. 9 folded upon itself in serpentine manner to occupy the space defined by envelope 212. For ease of installation and to insure that all of the space within the envelope will in fact be filled with fresh water and brine in their respective tubes, the double wall tubing may be first inflated to the size it would be were water and brine disposed therein. Evacuation of the air within the apparatus could be accomplished by a vacuum pump or simply by filling the outer tubing with water, as described in reference to FIG. 9. It may be noted that inner tube 180 is lodged naturally at the bottom of outer tubing 182. Such positioning assumes that the inner tube is free to float or sink within the outer tube. The inner tube is assumed to conduct a salt brine rather than less dense but more expensive glycol brine, and thus sinks in the fresh water in the annular space. The use of the concentric tubes positions and distributes the inner tubes evenly throughout the space to be filled with ice. The added expense of employing supports on positioning members to carefully position the inner tube with respect to the outer tube presently appears unjustified. As illustrated, a valve 220 may be interconnected with inner tube 180 or an extension thereof to regulate the flow rate of brine through the inner tube.

After each ice crib has been erected, the fresh water and brine interconnections therewith may be severed in the event continuing flow of chilled brine is unnecessary to maintain the ice crib frozen for the period of time during which it must provide the requisite support for the overburden. Alternatively, the connections may be retained intact to provide a means for continuous flow of chilled brine to insure non-melting of the ice crib during the period of time within which it must provide the requisite support of the overburden to remove the hazard and danger to equipment and personnel performing a mining function. Where the economies so justify, an existing ice crib which is to be melted, can be employed to precool the brine flowing into the refrigeration system and from which it flows into an ice crib to be formed. The resulting savings in refrigeration costs override the costs attendant the necessary conduit and fittings. Furthermore, by transmitting non-chilled brine through an existing ice crib, the melt rate thereof may be reasonably accurately controlled by regulating both the flow rate and temperature of the brine flowing into the ice crib. The chilled fresh water from a melted ice crib can also be pumped into an ice crib to be formed; or, it can be simply pumped out to collapse the ice crib.

The apparatus illustrated in FIG. 9 may be formed of relatively inexpensive tubing of man-made plastic materials and inexpensive plastic fittings as the pressures attendant operation of the apparatus are well within the limits of such materials. Thereby, the apparatus may be considered to be disposable and in fact it is probably less expensive to permit it to become buried in a cavein than to expend the funds necessary to retrieve it, handle it, transport it and store it. It may be noted that the pressures resulting from the support provided by an ice crib are borne by the ice and not the envelopes or tubing therefor.

Since apparatus 176 is collapsible, it is readily and economically storable and transportable. Moreover, it is simple to set up and operate which reduces the level of skilled manpower necessary for such purposes.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. An ice crib for filling a space to support an underground roof, said ice crib comprising in combination:

(a) a double walled tubing including a first tube and a second tube, said first tube being an outer tube and said second tube being an inner tube of said double wall tubing;

(b) means for introducing a first fluid into said first tube;

(c) means for conveying through said second tube a second fluid having a lower freezing point than the first fluid and at a temperature below the freezing point of the first fluid; and (d) means for conforming said ice crib to fill the predetermined space upon introduction of the first fluid and conveyance of the second fluid;

whereby, the second fluid will draw heat from the first fluid to freeze the first fluid and develop said ice crib of solid mass sized commensurate with the predetermined space to be filled.

2. The ice crib as set forth in claim 1 wherein said conveying means comprises a source of second fluid, a refrigeration unit and a pump.

3. The ice crib as set forth in claim 2 wherein the first fluid is fresh water and the second fluid is brine.

4. The ice crib as set forth in claim 1 including insulation means for thermally insulating at least the top and bottom of said ice crib.

5. The ice crib as set forth in claim 1 including means for serially interconnecting a plurality of said ice cribs.

6. The ice crib as set forth in claim 5 including insulating means for thermally insulating at least the top and bottom of said ice cribs.

7. The ice crib as set forth in claim 1 including an envelope for enclosing said ice crib.

8. The ice crib as set forth in claim 7 including insulation means for thermally insulating at least the top and bottom of said ice crib.

9. The ice crib as set forth in claim 8 wherein said conveying means comprises a source of second fluid, a refrigeration unit and a pump.

10. The ice crib as set forth in claim 9 including insulation means for thermally insulating at least the top and bottom of said ice crib.

11. The method as set forth in claim 1 including means for draining said first fluid.

12. The ice crib as set forth in claim 1 wherein said conveying means includes means for drawing off said second fluid.

13. The ice crib as set forth in claim 12 including means for draining said first fluid.

14. A method for filling a vertical space to support an underground roof with an ice crib, said method comprising the steps of:

(a) positioning apparatus within the space to define the ice crib;

(b) introducing into the apparatus and through a first tube a first fluid having a first freezing point; and (c) conveying through the apparatus and through a second tube surrounded by the first tube a second fluid having a second freezing point lower than that of the first fluid;

whereby, the first fluid will become frozen and define the ice crib in response to the heat drawn therefrom on conveyance through the apparatus of the second fluid at a temperature below the first freezing point.

15. The method as set forth in claim 14 wherein said positioning step includes the step of arranging the first tube to fill the space.

16. The method as set forth in claim 14 wherein said positioning step includes the step of inflating the first tube.

17. The method as set forth in claim 14 wherein the step of positioning includes the step of evacuating the first tube.

18. The method as set forth in claim 15 including the step of thermally insulating at least the top and bottom of the apparatus.

19. The method as set forth in claim 18 including the step of enclosing the apparatus within an envelope.

20. The method as set forth in claim 14 including the step of thermally insulating at least the top and bottom of the apparatus.

21. The method as set forth in claim 14 including the step of enclosing the apparatus within an envelope.

22. The method as set forth in claim 15 including the step of enclosing the apparatus within an envelope.

23. The method as set forth in claim 15 wherein the step of positioning includes the step of evacuating the first tube of air.

24. The method as set forth in claim 20 wherein the step of positioning includes the step of evacuating the first tube.

25. The method as set forth in claim 21 wherein the step of positioning includes the step of evacuating the first tube.

* * * * *